US012715080B2

(12) United States Patent
Chou et al.

(10) Patent No.: US 12,715,080 B2
(45) Date of Patent: Aug. 25, 2026

(54) OSCILLATING SANDING MACHINE

(71) Applicant: THE KINGCRAFT MACHINERY COMPANY LIMITED, Taichung City (TW)

(72) Inventors: Calvin Chou, Taichung City (TW); Ming-Ta Chou, Taichung City (TW)

(73) Assignee: THE KINGCRAFT MACHINERY COMPANY LIMITED, Taichung City (TW)

( * ) Notice: Subject to any disclaimer, the term of this patent is extended or adjusted under 35 U.S.C. 154(b) by 378 days.

(21) Appl. No.: 18/516,996

(22) Filed: Nov. 22, 2023

(65) Prior Publication Data

US 2025/0162098 A1 May 22, 2025

(51) Int. Cl.
*B24B 7/06* (2006.01)

(52) U.S. Cl.
CPC ..... *B24B 7/06* (2013.01)

(58) Field of Classification Search
CPC ..... B24B 7/06; B24B 7/188; B24B 7/224; B24B 7/242; B24B 7/244; B24B 7/245; B24B 7/247; B24B 7/28; B24B 9/002; B24B 9/005
See application file for complete search history.

(56) References Cited

U.S. PATENT DOCUMENTS 3,708,817 A * 1/1973 Rhine ..... B24D 13/10 451/130
3,945,153 A * 3/1976 Williams ..... B24B 41/005 451/260
4,742,650 A * 5/1988 Sauder, Jr. ..... B24B 21/06 451/300
7,004,818 B1 * 2/2006 Haney ..... B24B 7/28 451/157

* cited by examiner

*Primary Examiner* — Nathaniel E Wiehe
*Assistant Examiner* — Jason G Davis
(74) *Attorney, Agent, or Firm* — WPAT, PC

(57) ABSTRACT

An oscillating sanding machine includes a base column, an oscillating sanding spindle, a conveying unit, a first driving unit, a second driving unit, and a third driving unit. The first driving unit is for driving a rotating shaft of the oscillating sanding spindle to rotate about an axis it extends and the second driving unit is for driving the oscillating sanding spindle to move to and fro along the axis and perform oscillation. The conveying unit is located under the oscillating sanding spindle and separated from the oscillating sanding spindle by a predetermined distance. The third driving unit is mounted on the base column and connected to the conveying unit, so as to drive the conveying unit. The oscillating sanding machine provides high-precision control and ensures surface uniformity of sanded workpieces.

10 Claims, 6 Drawing Sheets

OSCILLATING SANDING MACHINE

BACKGROUND OF THE INVENTION

1. Technical Field

The present invention relates to sanding machines, and more particularly to an oscillating sanding machine.

2. Description of the Related Art

Existing sanding machines usually have a sanding spindle that performs rotation simply, and thus have defects in practical applications.

The first issue is about poor uniformity of the sanded workpiece surfaces and uneven wear of the sanding spindle. During rotation, the sanding spindle mainly performs a circling motion on a workpiece surface and tends to leave knife marks that lead to unsmooth appearance of the workpiece. On the other hand, a surface of the rotational sanding spindle is likely to receive uneven wearing over time and can eventually fail to maintain consistent sanding results. To prevent this, such a rotational sanding spindle needs frequent maintenance and replacement, increasing both operational costs and down time.

The second issue is about low working efficiency. Since rotational sanding only acts in one local area of the workpiece surface one time, it takes relatively long time for the machine to completely sand a large workpiece surface, and the time-consuming operation can lead to low working efficiency in heavy-load sanding tasks.

Hence, there is a need for a sanding machine that addresses the shortcomings of the existing products.

SUMMARY OF THE INVENTION

To meet such a need, the present invention provides an oscillating sanding machine that provides high-precision control and achieves smooth sanded workpiece surfaces.

To this end, the oscillating sanding machine of the present invention comprises a base column, an oscillating sanding spindle, a conveying unit, a first driving unit, a second driving unit, and a third driving unit. The conveying unit is located under the oscillating sanding spindle and separated from the oscillating sanding spindle by a predetermined distance. The first driving unit is connected to a rotating shaft of the oscillating sanding spindle for driving the oscillating sanding spindle to rotate about its axis. The second driving unit is connected to the oscillating sanding spindle for driving the oscillating sanding spindle to move to and fro along the axis. The third driving unit is connected to the conveying unit, so as to drive the conveying unit.

With the foregoing configuration, the oscillating sanding spindle of the present invention rotates while oscillating in a direction in which the rotating shaft extends, thereby ensuring surface uniformity of the sanded workpiece. Furthermore, by using plural drivers, the present invention provides precise control of the oscillating sanding spindle and the conveying unit, thereby achieving high-precision sanding.

DETAILED DESCRIPTION OF THE INVENTION

Figure 1:
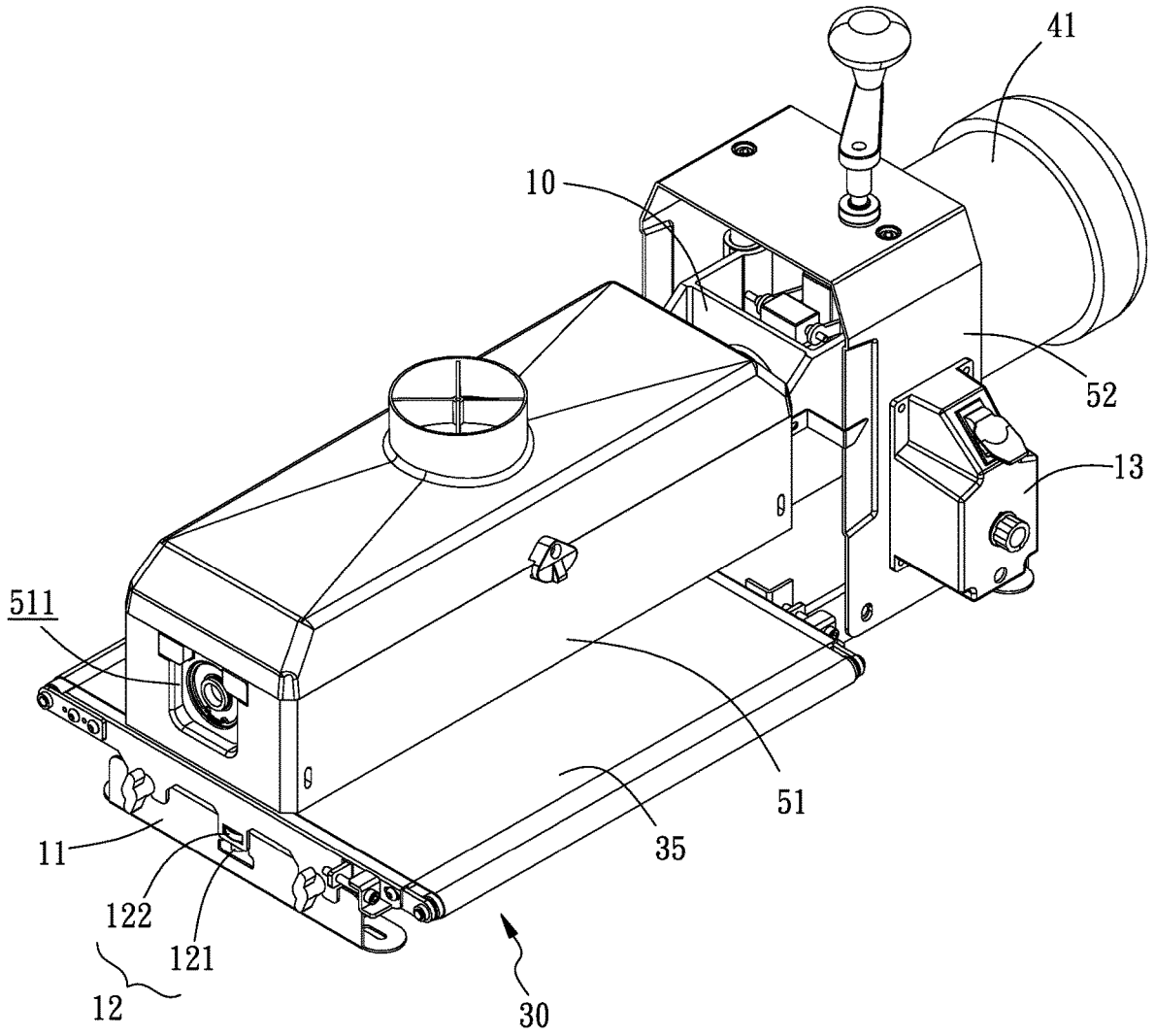
FIG. 1 is a perspective view of the base column of the present invention.

Referring to FIG. 1 through FIG. 6, in one embodiment of the present invention, an oscillating sanding machine comprises a base column 10, an oscillating sanding spindle 20, a conveying unit 30, a first driving unit 41, a second driving unit 42, and a third driving unit 43. The oscillating sanding spindle 20 and the conveying unit 30 are attached to the same side of the base column 10, and the conveying unit 30 is under the oscillating sanding spindle 20 and separated from the oscillating sanding spindle 20 by a predetermined distance. The first driving unit 41 is attached to the opposite side of the base column 10 and is connected to a rotating shaft of the oscillating sanding spindle 20 for driving the oscillating sanding spindle 20 to rotate about its axis. The second driving unit 42 is installed in the base column 10 and eccentrically connected to the oscillating sanding spindle 20 for driving the oscillating sanding spindle 20 to move along the axis to and fro. The third driving unit 43 is also installed on the base column 10 and is connected to the conveying unit 30 for driving the conveying unit 30.

The base column 10 is further provided with a console 13. The console 13 is configured to adjust the rotational speeds of the first driving unit 41, the second driving unit 42, and the third driving unit 43.

With the foregoing configuration, the present invention provides the following benefits.

First, the sanded workpiece surface is smooth and uniform because the oscillating sanding spindle 20 performs multi-direction movements, including rotation and oscillation. Also, the sanding process is efficient and consistent throughout a workpiece surface.

Second, high-precision control can be achieved because the base column 10 uses plural drivers to control movements of the oscillating sanding spindle 20 and the conveying unit 30 separately. This enables precise sanding and prevents over- and under-removal of material from the workpiece.

Figure 2:
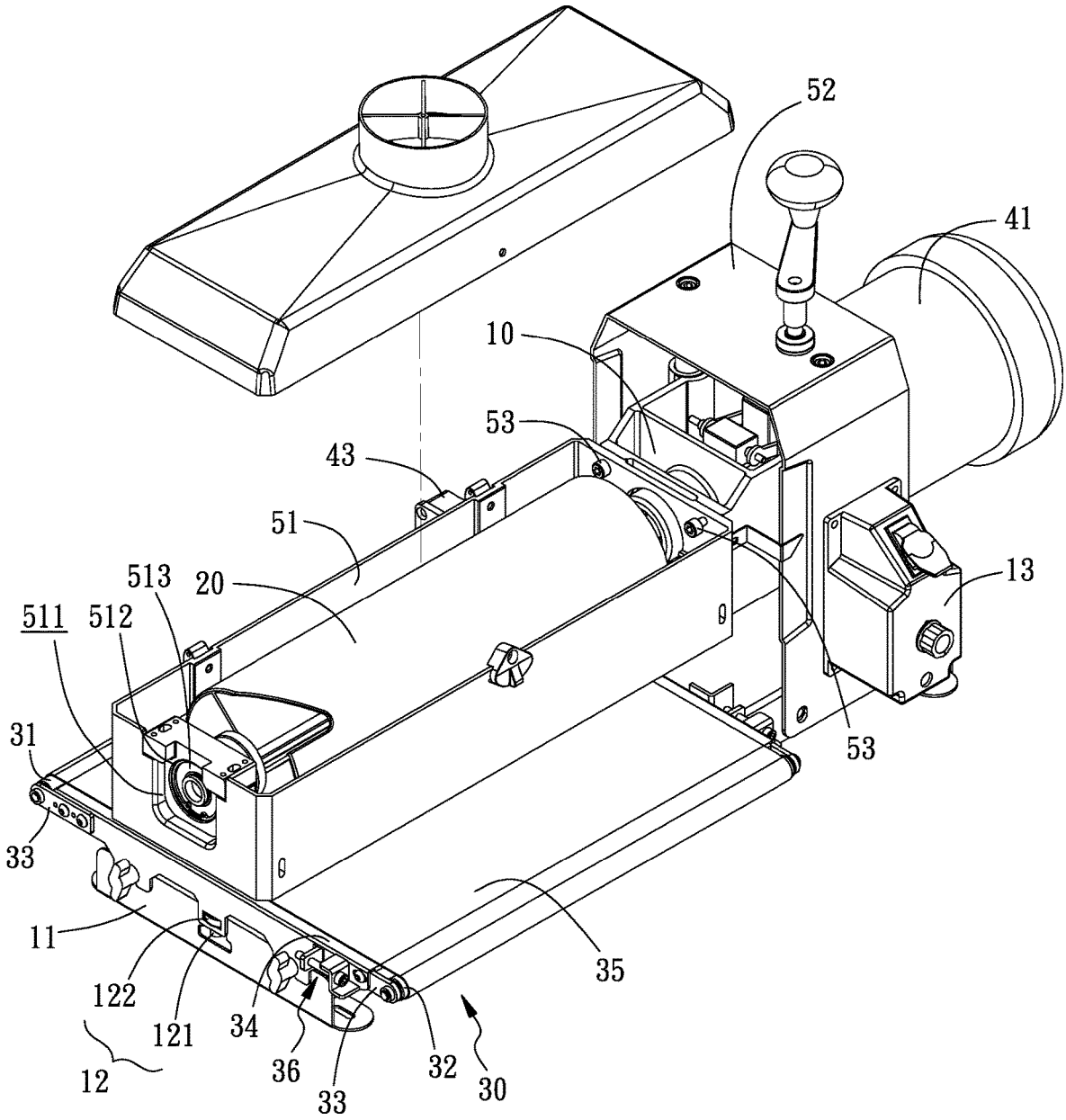
FIG. 2, similar to FIG. 1, shows the interior of the present invention by opening the first casing part.

Now referring to FIG. 2 together with FIG. 1, the oscillating sanding spindle 20 is cased in a first casing part 51, and the first driving unit 41 is partially cased in a second casing part 52. The first casing part 51 and the second casing part 52 are both fixed to the base column 10. Provision of the first casing part 51 and the second casing part 52 is to not only protect the interior machinery but also prevent machine operators from unintentionally accessing the oscillating sanding spindle 20, thereby reducing risks of accident.

Still referring to FIG. 2 together with FIG. 1, the first casing part 51 has its end away from the first driving unit 41 provided with a positioning hole 511 that receives a bearing seat 512. The bearing seat 512 holds therein a bearing 513, and the oscillating sanding spindle 20 has its one end coupled with the bearing 513. Provision of the bearing 513 helps support the oscillating sanding spindle 20 and share loading, thereby reducing wear and friction and extending the service life of the equipment. In addition, the bearing 513 protects the oscillating sanding spindle 20 from excessive vibration and rocking, thereby achieving more precise sanding.

Also, as shown in FIG. 2, a plurality of fixing screws 53 is symmetrically arranged to fix the first casing part 51 and the second casing part 52 together. The fixing screws 53 are used to finely adjust levelness of the first casing part 51, and in turn levelness of the oscillating sanding spindle 20. The foregoing configuration enables optimal adjustment of the oscillating sanding spindle 20 in terms of levelness, so as to ensure uniform contact between the oscillating sanding spindle 20 and the workpiece, thereby accomplishing high-precision sanding.

Reference is made to FIG. 2 again. The conveying unit 30 comprises a first axle 31, a second axle 32, a plurality of fixing members 33, a support plate 34, and a conveying belt 35. The support plate 34 is mounted on the base column 10 with its two sides coupled with the first axle 31 and the second axle 32, respectively, through the plurality of fixing members 33. The first axle 31 is connected to the third driving unit 43. The conveying belt 35 is routed around the support plate 34, the first axle 31, and the second axle 32.

Figure 3:
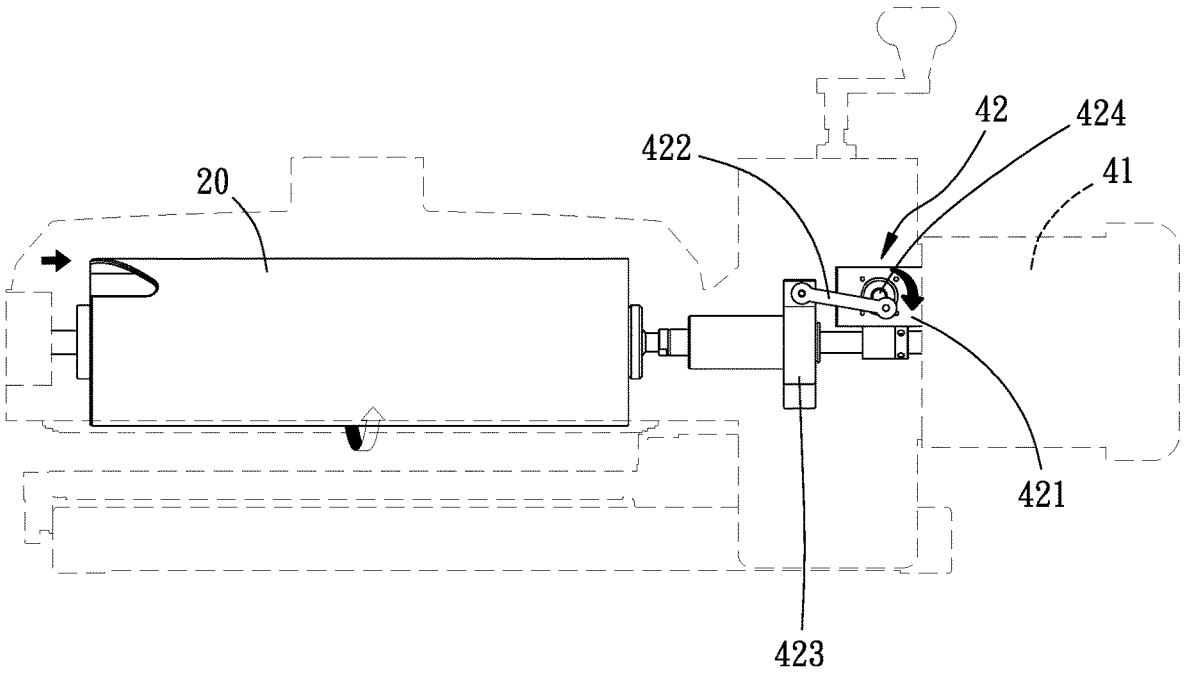
FIG. 3 is a schematic drawing showing that the second driving unit rotates rightward to drive the oscillating sanding spindle to move rightward.
Figure 4:
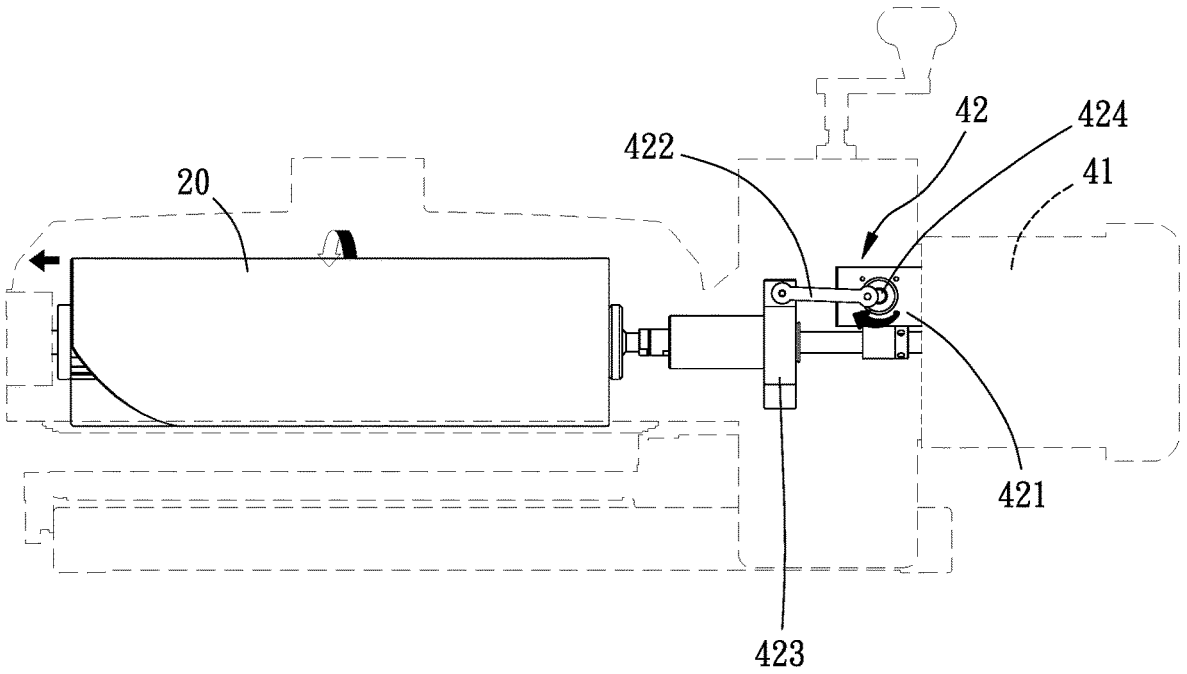
FIG. 4, similar to FIG. 3, shows that the second driving unit rotates leftward to drive the oscillating sanding spindle to move leftward.

Referring to FIG. 3 and FIG. 4 together with FIG. 1 and FIG. 2, the second driving unit 42 comprises a gear box 421, a link 422, a cam 424, and a slider 423. The cam 424 is coupled to an output shaft of the gear box 421. The link 422 has one end eccentrically coupled with the cam 424 and an opposite end coupled with the slider 423. The slider 423 is transmissively coupled with the oscillating sanding spindle 20. FIG. 3 discloses that when the cam 424 operates, it drives the link 422 to rotate rightward, so the slider 423 at the opposite end of the link 422 is driven to move rightward, thereby making the oscillating sanding spindle 20 coupled to the slider 423 move rightward. On the contrary, as shown in FIG. 4, when the cam 424 rotates to the left, the link 422 also moves to the left and pushes the slider 423 to the left, thereby making the oscillating sanding spindle 20 move leftward. With the foregoing configuration, the second driving unit 42 can drive the oscillating sanding spindle 20 to move to and fro in a travel range of about 15-30 mm.

Figure 5:
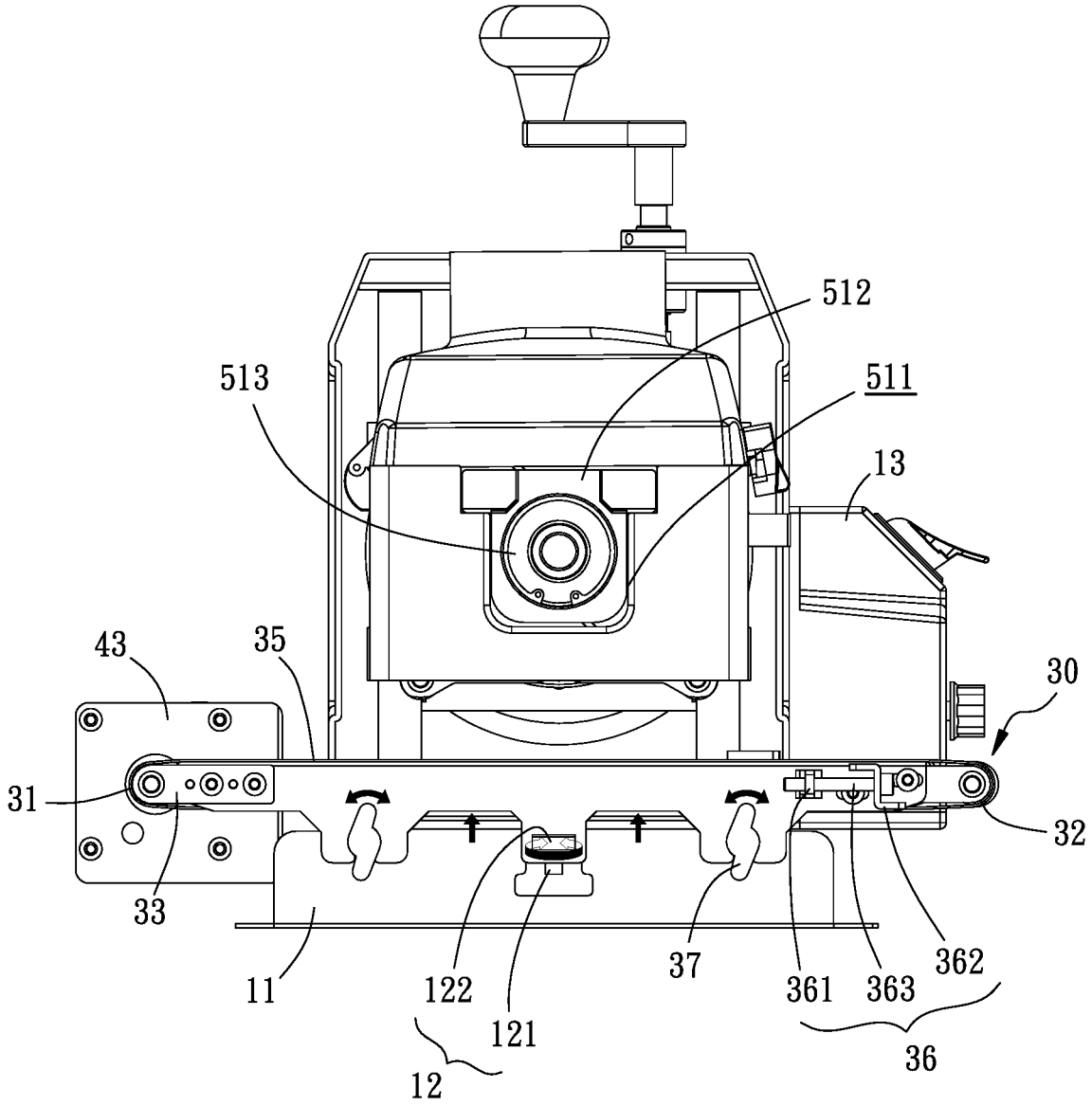
FIG. 5 is a front view of the present invention showing that the height adjuster performs height adjustment on the conveying unit.
Figure 6:
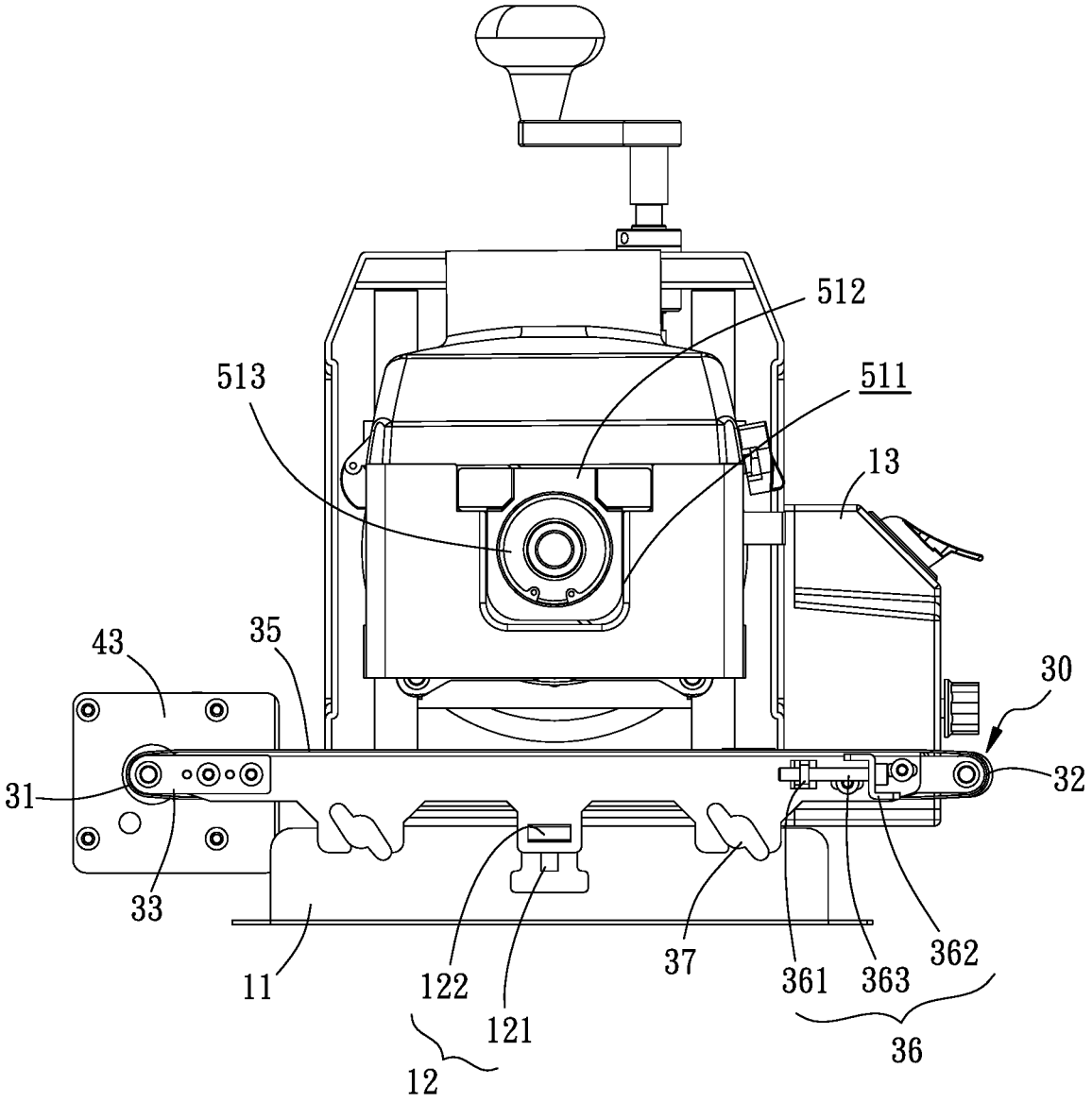
FIG. 6, similar to FIG. 5, shows that the conveying unit has been moved upward.

Now referring to FIG. 5 and FIG. 6 along with FIG. 1 and FIG. 2, the base column 10 further comprises a baseplate 11. The baseplate 11 has an edge provided with a height adjuster 12. The height adjuster 12 is coupled with the support plate 34 for adjusting an altitude of the support plate 34 unilaterally. The height adjuster 12 is formed by assembling a bolt 121 to a rotating unit 122 and used to make the conveying unit 30 move upward or downward.

Moreover, the conveying unit 30 is laterally provided with a plurality of positioning members 37. The positioning members 37 serve to limit relative displacement between the conveying unit 30 and the baseplate 11. By screwing the positioning members 37 to tight, the relative distance between the conveying unit 30 and the baseplate 11 can be narrowed, thereby preventing the conveying unit 30 from performing uncontrolled upward or downward displacement. When the positioning members 37 are screwed to loose, the conveying unit 30 can be moved upward or downward by the height adjuster 12. After the foregoing adjustment, the positioning members 37 can be screwed to tight again to position the conveying unit 30 at the adjusted position.

Now referring to FIG. 5 and FIG. 6 as well as FIG. 1 and FIG. 2, each of the fixing members 33 at two ends of the second axle 32 is coupled to a respective incline-adjusting structure 36. The incline-adjusting structures 36 are used to adjust the incline angle of the second axle 32 with respect to the level (or the ground). The incline-adjusting structure 36 comprises a first fixing section 361, a second fixing section 362, and an adjusting bolt 363. The first fixing section 361 is provided at a lateral of the support plate 34, and the second fixing section 362 is provided at a lateral of the fixing member 33. The first fixing section 361 and the second fixing section 362 are at the same altitude. The adjusting bolt 363 is screwed into and passes through both of the first fixing section 361 and the second fixing section 362.

With the foregoing configuration, during replacement of the conveying unit 30, to ensure that the newly installed conveying unit 30 is posed at the same angle as the replaced one, the incline-adjusting structure 36 can be used to perform fine adjustment for inclining the second axle 32 and thereby pose the conveying unit 30 at the desired angle. For example, at the left end of the second axle 32 that is positioned levelly, by screwing the adjusting bolt 363 into the first fixing section 361 and the second fixing section 362, the relative distance between the first fixing section 361 and the second fixing section 362 is narrowed, so the left end of the second axle 32 moves upward. At this time, with the adjusting bolt 363 at the right end of the second axle 32 remains unoperated, the second axle 32 becomes inclined toward its lower right corner.

What is claimed is:

1. An oscillating sanding machine, comprising:

a base column;

an oscillating sanding spindle, being installed on the base column;

a conveying unit, being installed on the base column so that the conveying unit is located under the oscillating sanding spindle and separated from the oscillating sanding spindle by a predetermined distance;

a first driving unit, being installed on the base column and connected to a rotating shaft of the oscillating sanding spindle so as to drive the oscillating sanding spindle to rotate about an axis thereof;

a second driving unit, being installed on the base column and connected to the oscillating sanding spindle so as to drive the oscillating sanding spindle to move to and from along the axis; and a third driving unit, being installed on the base column and connected to the conveying unit so as to drive the conveying unit;

wherein the conveying unit comprises a first axle, a second axle, a plurality of fixing members, a support plate, and a conveying belt, in which the support plate is mounted on the base column so that two laterals of the support plate are coupled to the first axle and the second axle through the fixing members, and the first axle is connected to the third driving unit, while the conveying belt is routed around the support plate, the first axle, and the second axle; and wherein the fixing members coupled to two ends of the second axle are each coupled to a respective incline-adjusting structure, and the incline-adjusting structures are used to adjust an incline angle of the second axle with respect to a level.

2. The oscillating sanding machine of claim 1, wherein the base column further comprises a baseplate, and the baseplate has an edge provided with a height adjuster that is coupled with the support plate, in which the height adjuster is formed by assembling a bolt to a rotating unit and used to make the conveying unit move upward or downward.

3. The oscillating sanding machine of claim 2, wherein the conveying unit is laterally provided with a plurality of positioning members, which serves to limit relative displacement between the conveying unit and the baseplate.

4. The oscillating sanding machine of claim 1, wherein each of the incline-adjusting structures comprises a first fixing section, a second fixing section, and an adjusting bolt, in which the first fixing section is provided at a lateral of the support plate, and the second fixing section is provided at a lateral of the fixing member so that the first fixing section and the second fixing section are at an identical altitude and the adjusting bolt is screwed into and passes through both of the first fixing section and the second fixing section.

5. The oscillating sanding machine of claim 1, wherein the oscillating sanding spindle is cased in a first casing part, and the first driving unit is partially cased in a second casing part, in which the first casing part and the second casing part are both fixed to the base column.

6. The oscillating sanding machine of claim 5, wherein the first casing part has an end thereof away from the first driving unit provided with a positioning hole that receives a bearing seat, and the bearing seat holds therein a bearing, in which the oscillating sanding spindle has one end thereof coupled with the bearing.

7. The oscillating sanding machine of claim 6, wherein a plurality of fixing screws is symmetrically arranged to fix the first casing part and the second casing part together, in which the fixing screws are used to finely adjust the first casing part and in turn the oscillating sanding spindle in terms of levelness.

8. The oscillating sanding machine of claim 1, wherein the second driving unit comprises a gear box, a cam, a link and a slider, in which the cam is coupled to an output shaft of the gear box, and the link has one end thereof eccentrically coupled with the cam and an opposite end thereof coupled with the slider, while the slider is transmissively coupled with the oscillating sanding spindle.

9. An oscillating sanding machine, comprising:

a base column;

an oscillating sanding spindle, being installed on the base column;

a conveying unit, being installed on the base column so that the conveying unit is located under the oscillating sanding spindle and separated from the oscillating sanding spindle by a predetermined distance;

a first driving unit, being installed on the base column and connected to a rotating shaft of the oscillating sanding spindle so as to drive the oscillating sanding spindle to rotate about an axis thereof;

a second driving unit, being installed on the base column and connected to the oscillating sanding spindle so as to drive the oscillating sanding spindle to move to and from along the axis; and a third driving unit, being installed on the base column and connected to the conveying unit so as to drive the conveying unit;

wherein the oscillating sanding spindle is cased in a first casing part, and the first driving unit is partially cased in a second casing part, in which the first casing part and the second casing part are both fixed to the base column; and wherein the first casing part has an end thereof away from the first driving unit provided with a positioning hole that receives a bearing seat, and the bearing seat holds therein a bearing, in which the oscillating sanding spindle has one end thereof coupled with the bearing.

10. The oscillating sanding machine of claim 9, wherein a plurality of fixing screws is symmetrically arranged to fix the first casing part and the second casing part together, in which the fixing screws are used to finely adjust the first casing part and in turn the oscillating sanding spindle in terms of levelness.

* * * * *